US005534681A

United States Patent [19]

Hwang

[11] Patent Number: 5,534,681

[45] Date of Patent: Jul. 9, 1996

[54] MICROWAVE OVEN WITH ELECTRIC HEATER ADJUSTABLE TO DIFFERENT POSITIONS

[75] Inventor: Yun-Ic Hwang, Suwon, Rep. of Korea

[73] Assignee: Samsung Electronics Co., Ltd., Suwon, Rep. of Korea

[21] Appl. No.: 440,349

[22] Filed: May 12, 1995

[30] Foreign Application Priority Data

May 12, 1994 [KR] Rep. of Korea ..... 94-10500 U
Feb. 17, 1995 [KR] Rep. of Korea ..... 95-2594 U

[51] Int. Cl.[6] ..... H05B 6/80

[52] U.S. Cl. ..... 219/685; 219/681; 219/404

[58] Field of Search ..... 219/685, 681, 219/404; 99/325

[56] References Cited

U.S. PATENT DOCUMENTS 4,481,396 11/1984 Matsubayashi ..... 219/681
4,596,914 6/1986 Morino ..... 219/685
4,629,850 12/1986 Tanabe ..... 219/685

FOREIGN PATENT DOCUMENTS 61-119925 6/1986 Japan ..... 219/685
61-259029 11/1986 Japan ..... 219/685
62-60617 12/1987 Japan .

*Primary Examiner*—Philip H. Leung
*Attorney, Agent, or Firm*—Burns, Doane, Swecker & Mathis

[57] ABSTRACT

A microwave oven includes a cooking chamber, a magnetron for directing microwaves into the chamber, and an electric heater disposed within the cooking chamber. The heater is mounted for rotation about a horizontal axis so as to be moved between horizontal and vertical orientations. A fan disposed outside the cooking chamber blows air through apertures formed in a wall of the cooking chamber to cause heat within the cooking chamber to be circulated. The heater is of inverted U-shape when vertically oriented and is rotated by an electric motor between the vertical and horizontal positions.

12 Claims, 4 Drawing Sheets

MICROWAVE OVEN WITH ELECTRIC HEATER ADJUSTABLE TO DIFFERENT POSITIONS

BACKGROUND OF THE INVENTION

1. Field of the Invention

The present invention relates to a microwave oven employing a magnetron and a heater for performing an oven (microwave) cooking function, a grill cooking function, a convection cooking function and a combination cooking function, and more particularly to a heater position control apparatus of a microwave oven by which a heater position can be changed to a place where a user requires when food is cooked or a cooking chamber is cleaned, to thereby cause the food to be easily cooked, and at the same time, to cause the cooking chamber to be easily cleaned, while construction thereof is simple to thereby reduce the manufacturing cost and to improve productivity as well.

2. Description of the Prior Art

Generally, a microwave oven equipped with a magnetron and a heater for performing an oven cooking function, a grill cooking function, convection cooking function and a combination cooking function has been disclosed in various forms.

As a prior art for a conventional microwave oven, Japanese patent publication No. Sho 62-60617 applied for in Dec. 17, 1982 by Matsushita Electric Company and published in Japan on Dec. 17, 1987 is disclosed.

The Japanese patent publication No. Sho 62-60617, as illustrated in FIG. 1, includes a heating chamber A, a high frequency oscillator 4, a sensor 5 for detecting humidity of food heated by the high frequency oscillator 4 or for detecting concentrated degree of gas, and a heater 6 for heating the food, whereby the sensor 5 is disposed near the heater 6 in order to directly receive radiant heat of the heater 6.

However, there is a problem in that the conventional microwave oven cannot easily grill-cook the food because the heater 6 is fixedly disposed within the heating chamber A, and a ceiling of the heating chamber A cannot be simply cleaned since the heater 6 is in the way.

Furthermore, there is another problem in that, when the food is heated by the heater 6 for grill-cooking the food, the heat generated from the heater 6 is not convected but is only radiated downwards, thereby preventing the food from being easily cooked.

In order to solve the above-referenced problems, a microwave oven according to U.S. Pat. No. 4,596,914 has been disclosed. However, there is still another problem in the said microwave oven according to the U.S. Pat. No. 4,596,914 in that a construction for controlling the position of the heater is complicated to thereby increase a manufacturing cost thereof and decrease productivity thereof.

SUMMARY OF THE INVENTION

The present invention is therefore disclosed to solve the aforesaid problems and it is an object of the present invention to provide a heater position control apparatus of a microwave oven by which position of a heater can be automatically moved to a place where a user requires, to thereby cause the food to be easily cooked and to cause a cooking chamber to be easily cleaned.

It is another object of the present invention to provide a heater position control apparatus of a microwave oven by which a construction for controlling the position of the heater can be compactly made, to thereby improve a productivity and to reduce a manufacturing cost thereof.

In order to accomplish the objects of the present invention, there is provided a heater position control apparatus of a microwave oven employing a body constituting an enclosure thereof and a cooking chamber formed by a cavity within the body, the apparatus comprising:

a heater disposed at the cooking chamber to thereby be rotated therein;

power generating means for being fixed to one side of the cavity in order to generate an operating power for rotation of the heater;

power transmission means for transferring the power generated from the power generating means; and heater supporting means for being rotated by the power transmitted from the power transmission means to thereby support the heat.

According to the present invention of the heater position control apparatus of a microwave oven, the user can easily change a position of the heater to a place where it is required and at the same time, the food can be easily cooked because the heat generated from the heater is forcibly circulated within the cooking chamber, and the cooking chamber can be easily cleaned.

Furthermore, construction thereof is compactly made up so that a manufacturing cost can be reduced and productivity can be increased.

BRIEF DESCRIPTION OF THE DRAWINGS

For a better understanding of the nature and objects of the invention, reference should be made to the following detailed description taken in conjunction with the accompanying drawings in which.

DETAILED DESCRIPTION OF PREFERRED EMBODIMENTS OF THE INVENTION

Figure 1:
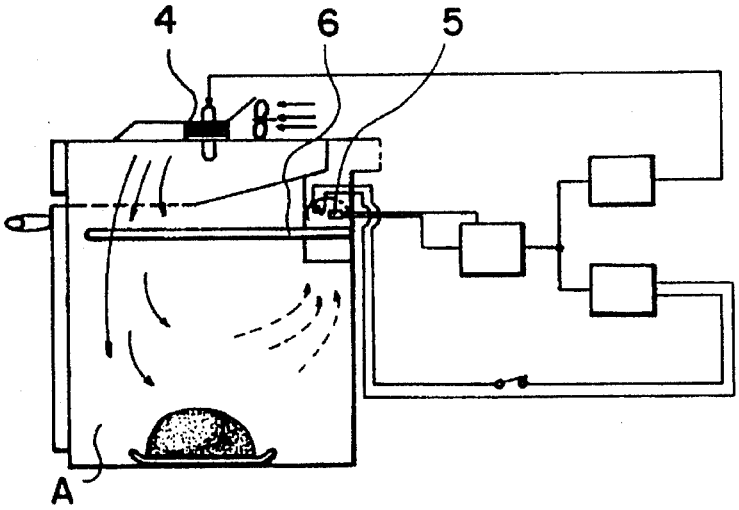
FIG. 1 (PRIOR ART)
FIG. 1 is a schematic sectional view for illustrating a microwave oven according to the prior art.

In FIG. 2, 3, 4 and 5, reference numeral 10 denotes a body of a microwave oven wherein a cavity 12 constituting a cooking chamber 11 is inherently disposed so as to perform an oven cooking, grill cooking, convection cooking or a combination cooking.

The body 1 possesses a magnetron 13 for generating microwaves to thereby cause the food to be oven-cooked and a heater 20 for generating the heat to thereby cause the food to be grill-cooked.

The cavity 12 for constituting the cooking chamber 11 of the body 10 is provided at one side thereof with power generating means 60 for generating the power so that the heater 20 can be moved by a control signal of control means (not shown), power transmission means 40 for transferring the power generated from the power generating means 60, heater supporting means 30 for being rotated about a horizontal axis by the power transferred by the power transmission means 40 to thereby support the heater 20, and position sensing means 70 for being fixed to one side of the power transmission means 40 so that a new position of the heater 20 supported by the heater supporting means 30 can be discriminated to thereby deactivate the power generating means 60.

In other words, the cavity 12 is provided at one side thereof with a support member 50 as a support for the power generating means 60 for generating the power by the control signal of the control means (not shown) in order to move the heater 20.

Furthermore, the support member 50 supports the power transmission means 40 for transferring the power generated from the power generating means 60 so that the heater 20 can be moved.

In other words, the power transmission means 40 includes a first gear member 41 for being inserted onto a shaft 61 of the power generating means 60 to thereby be rotated by the power of the power generating means 60, a second gear member 42 carrying a protrusion 421 and meshing with the first gear member 41 for being rotated in cooperation with the first gear member 42, and a transmission member 44 for being fixed at one end thereof to the protrusion 421 of the second gear member 42 and for being mounted at the other end thereof to the heater supporting means 30, to thereby transfer rotation of the second gear member 42 to the heater supporting means 30, whereby the power generated from the power generating means 60 can be transferred to the heater supporting means 30 to thereby move the position of the heater 20.

The second gear member 42 is rotatably mounted on a support shaft 43 fixed on the support member 50 to thereby be rotated in cooperation with the first gear member 41.

Figure 2:
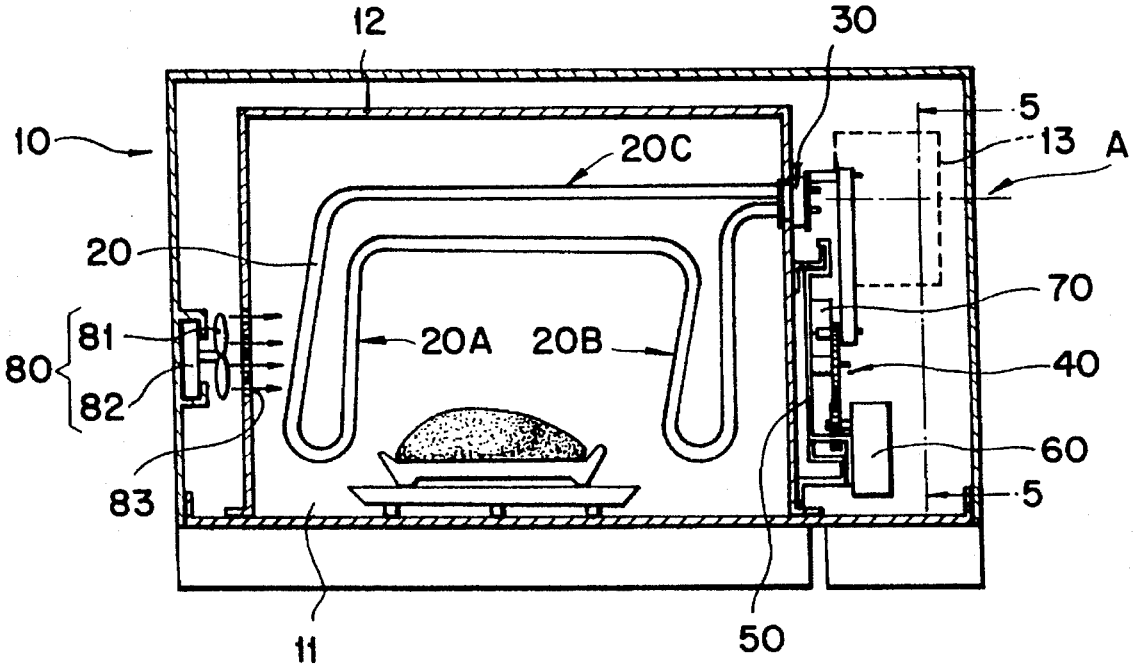
FIG. 2 is a schematic sectional view for illustrating an inner construction of a microwave oven in a state where a heater according to the present invention is disposed adjacent the rear of a cooking chamber.

The heater 20 comprises a heater element having a pair of legs 20A, 20B interconnected by a connector portion 20C. The connector portion defines the rotational axis A which is located in an upper portion of the cooking chamber. When the heater element is in a vertical orientation, it forms an inverted U-shape, whereby food can be placed between the legs 20A, 20B, as shown in FIG. 2.

Furthermore, the heater supporting means 30 includes a disk 31 having holes 311 through which respective ends of the heater 20 pass, holes 312, and a bracket member 33 for being fixed to the disk 31 by fasteners 34 such as bolts or the like so that the flange member 31 can be rotated, and for being protruded by a protruder 331 so that one end of the transmission member 44. A spacer member 32 is provided for maintaining a gap between the bracket member 33 and the disk 31 so that both members 31 and 33 can be easily rotated.

The bracket member 33 is formed with an opening 332 of approximate oval shape so as to permit one end of the heater 20 to pass therethrough and a top hole 333 so as to be fixed to the flange member 31 by the bolts 34.

In other words, when the power transferred by the transmission member 44 of the power transmission means 40 is transferred to the bracket member 33, the bracket member 33 is rotated, and because the disk 31 is rotated in cooperation with the rotation of the bracket member 33, the heater 20 supported on the disk 31 is in turn rotated.

Meanwhile, the position sensing means 70 serves to detect the position of the heater 20 to thereby turn off the power generating means 60.

In other words, because the position sensing means 70 is fixed to one side of the second gear member 42 of the power transmission means 40 to thereby detect the rotation of the second gear member 42 and serves to detect the position of the heater 20 by way of detection of rotation of the second gear member 42, the position of the heater 20 is discriminated to thereby transmit a control signal of control means (not shown) to deactivate the power generating means 60 when the heater is in a desired position.

Furthermore, the cavity in which the power generating means 60 and the like are fixed is formed at the other end thereof with convection means 80 for forcibly circulating the heat generated from the heater 20 within the cooking chamber 11 so that the food can be easily and convectionally cooked.

In other words, the convection means 80 includes a motor 82 for being fixed to the cavity 12 to receive power from an elelctric power supply means (not shown), thereby generating the power, and a fan 81 for being rotated by the power generated by the motor 82, thereby wind power is provided into the cooking chamber 11 to thereby circulate the heat generated from the heater 20 forcibly.

Furthermore, the cavity 12 where the fan 81 is disposed is perforated by a plurality of air holes 83.

An operational effect of the heater position control apparatus of the microwave oven thus constructed according to the present invention will now be described.

Figure 3:
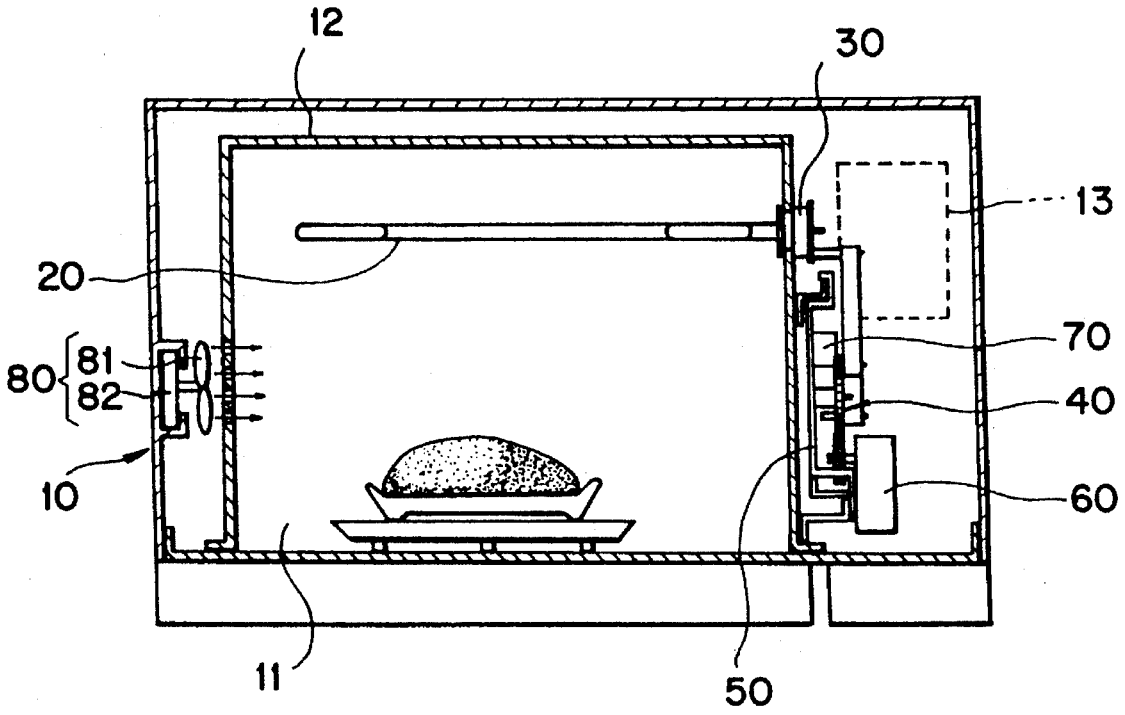
FIG. 3 is a schematic sectional view for illustrating the inner construction of the microwave oven in a state where the heater accoridng to the present invention is disposed at a ceiling of the cooking chamber.
Figure 4:
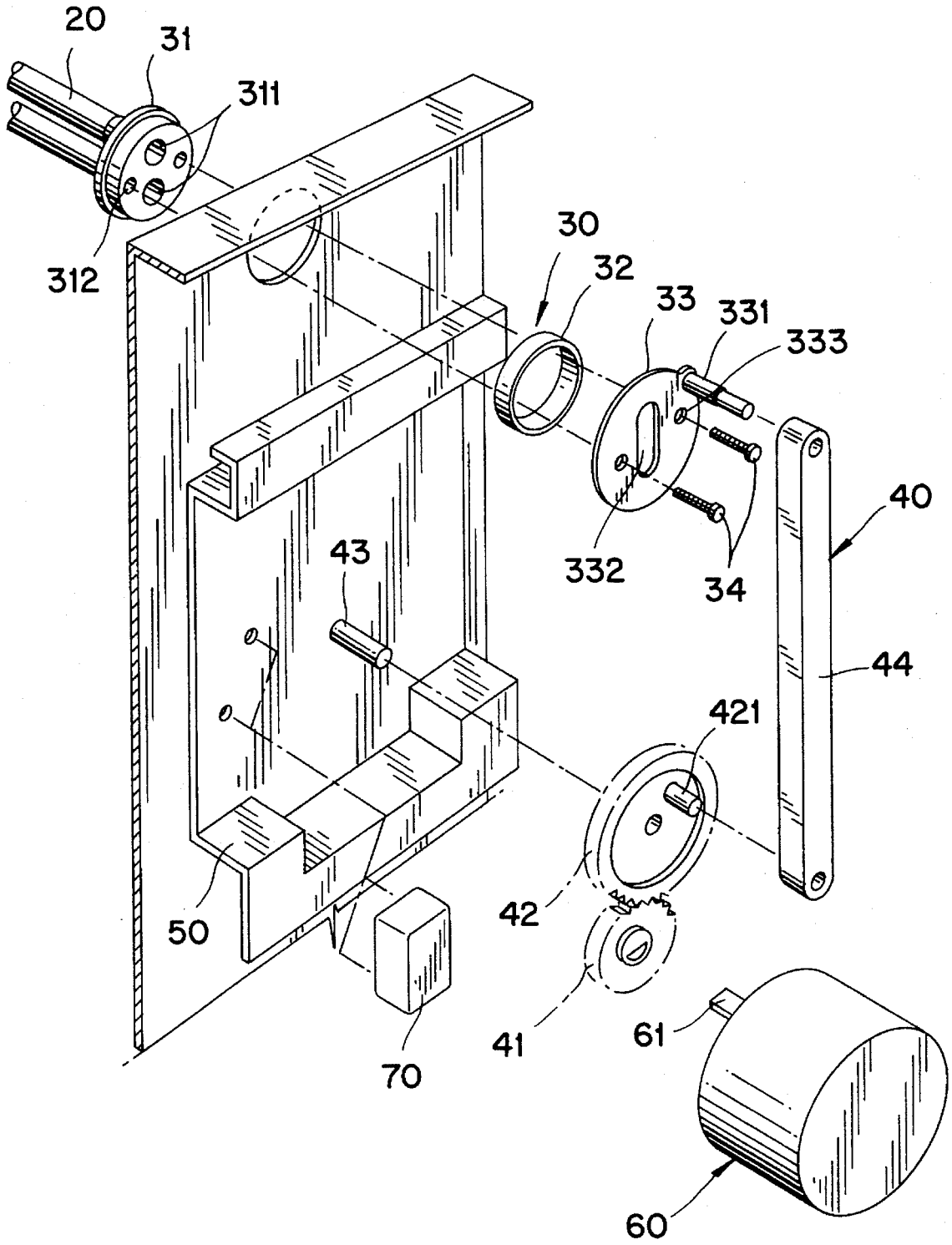
FIG. 4 is an exploded perspective view for illustrating exploded principal parts according to the present invention.
Figure 5:
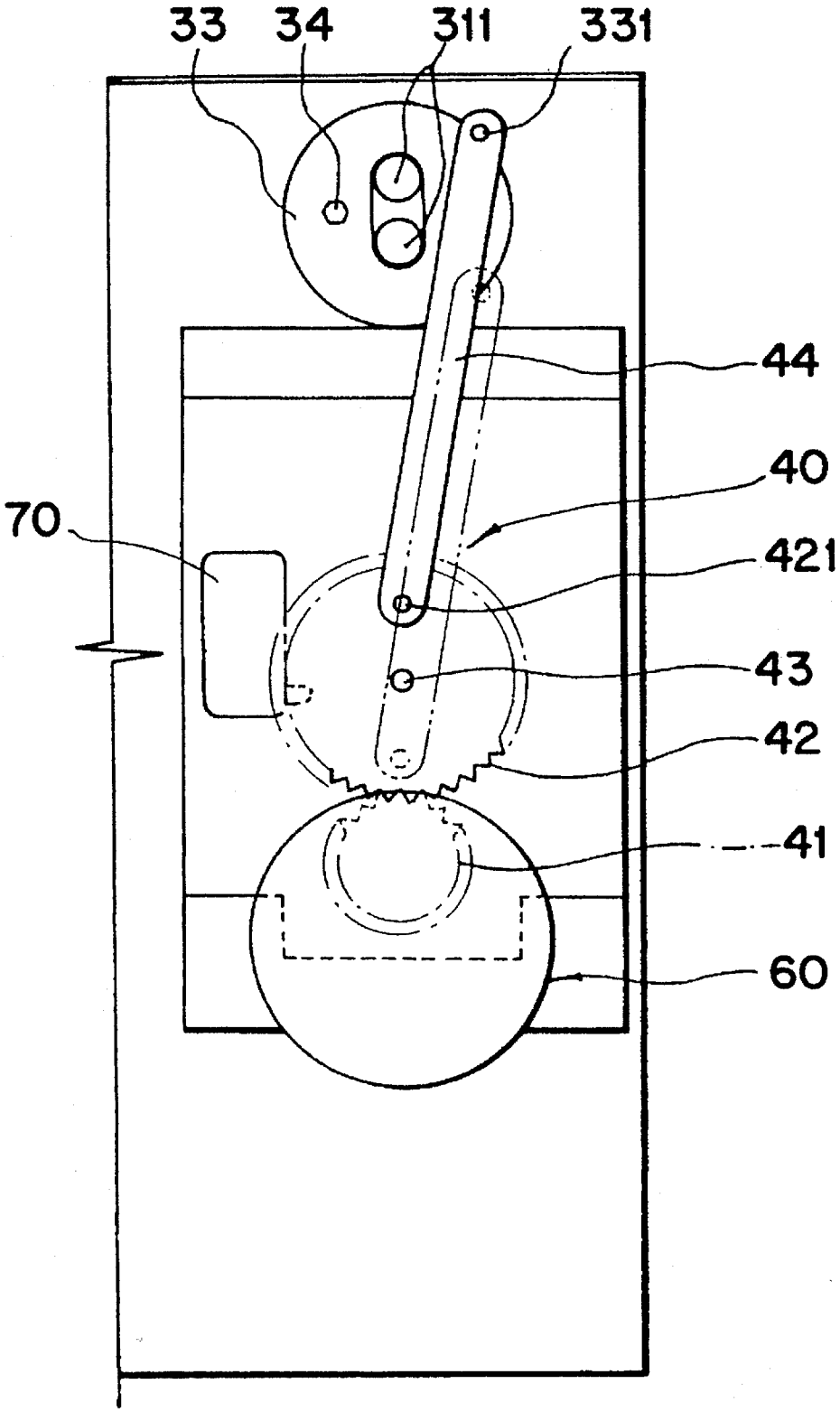
FIG. 5 is a side view for schematically illustrating a portion of the microwave oven as viewed in the direction of arrows 5—5 in FIG. 2.

First of all, when the user wants to dispose the heater 20 on a ceiling portion of the cooking chamber 11 in order to grill-cook the food, he or she controls control means (not shown) to thereby position the heater 20 adjacent the ceiling portion of the cooking chamber as illustrated in FIG. 3.

When the user wants to dispose the heater 20 at a rear portion of the cooking chamber 11 in order to clean the ceiling portion of the cooking chamber 11 or to barbecue the food, he or she controls the control means (not shown) to thereby position the heater 20 adjacent the rear portion of the cooking chamber 11 as illustrated in FIG. 2.

In other words, when the control means (not shown) is controlled, power is generated from the power generating means 40, and by way of the power of the power generating means 40, the first gear member 41 provided at the shaft 61 of the power generating means, 60 is rotated.

Furthermore, in cooperation with the rotation of the first gear member 41, the second gear member 42 meshed into the first gear member 41 is rotated, and the rotation of the second gear member 42 is transferred to the bracket member 33 by the transmission member 44.

As the bracket member 33 is rotated by the transmitted power of the transmission member 44, the disk 31 fixed to the bracket member 33 is caused to be rotated.

The heater 20 supported on the disk 31 is rotated to thereby position the heater 20 at the rear portion of the cooking chamber 11.

At this time, when the heater 20 is positioned at the rear portion of the cooking chamber 11, the position sensing means 70 serves to transmit a control signal to control means (not shown), turn off the power generating means 60.

In other words, when the user wants to shift the position of the heater 20, the control means is controlled to thereby cause the power generating means 60 to generate the power, and the power generated by the power generating means 60 is transferred to the heater supporting means 30 by the power transmission means 40, thereby shifting the position of the heater 20 supported to the heater supporting means 30.

Furthermore, when the heater 20 is shifted to a predetermined position controlled by the user, the position sensing means 70 detects this, thereby transmitting a control signal to the control means, so that power supply from the power generating means 60 is cut off and the heater 20 can be shifted to a position the user requires.

Meanwhile, when the heat is radiated from the heater 20, power is supplied to the motor 82 of the convection means 80 by a control signal of the control means (not shown) to thereby cause the motor 82 to generate the power, and the fan 81 is rotated by the power of the motor 82.

The wind power generated by the rotation of the fan 81 is supplied into the cooking chamber 11 through the plurality of air holes 83, and the heat generated by the heater 20 is forcibly circulated by the wind power supplied to the cooking chamber 11 to thereby cause the food to be convection-cooked.

As is apparent from the foregoing, according to the present invention of the heater position control apparatus of a microwave oven, the heater can be easily shifted to a user-wanted position to thereby enable effective cooking of the food, and at the same time, to enable a easy performance of cooking chamber cleaning for betterment of microwave oven quality.

According to the present invention of the heater position control apparatus of a microwave oven, the heat generated by the heater can be forcibly circulated in the cooking chamber by the convection means, thereby enabling the food to be convectionally cooked.

According to the present invention of the heater position control apparatus of a microwave oven, a construction for shifting the position of the heater is simple to thereby reduce a manufacturing cost and to increase the productivity thereof.

What is claimed is:

1. A microwave oven having a body constituting an enclosure and a cooking chamber formed by a cavity within the body, the apparatus comprising:

a heater assembly including a support mounted in the body for rotation relative thereto and a heating element fixed to the support and situated in the cooking chamber for movement between different positions therein in response to rotation of the support;

power generating means fixed to the body adjacent one side of the cavity to generate an operating power for rotation of the heater; and power transmission means for transferring the power generated by the power generating means to the heating element, the power transmission means comprising a gear rotated by the power generating means, and a transmission member having a first end rotatably mounted to the gear by a projection extending between the first end and the gear, the transmission member including a second end pivotally connected to the support.

2. A microwave oven as defined in claim 1 wherein the power transmission means includes position sensing means in order to discriminate a position of the heating element and to turn off the power generating means.

3. A microwave oven as defined in claim 1 including convection means to forcibly circulate the heat generated by the heating element within the cooking chamber.

4. A microwave oven as defined in claim 3, wherein the convection means comprises:

a motor fixed to the body adjacent to the cavity; and a fan rotated by the motor.

5. A microwave oven as defined in claim 1 wherein the gear constitutes a driven gear, the power transmission means further comprising a drive gear directly driven by the power generating means and meshing with the driven gear.

6. A microwave oven as defined in claim 1, wherein the heater support comprises:

a flange member formed with holes through which two ends of the heating element pass;

a bracket member fixed to the flange member by a fastener for common rotation therewith;

the second end of the transmission member being pivotally connected to the bracket member by a protrusion extending between the bracket and the transmission member; and a spacer for maintaining a gap between the bracket member and the flange member to facilitate rotation thereof.

7. A microwave oven as defined in claim 1, wherein the gear includes a lateral surface, the protrusion comprising a pin fixed to the lateral surface.

8. A microwave oven as defined in claim 1, wherein the transmission member is a rod.

9. A microwave oven as defined in claim 1, wherein the heating element includes a pair of legs interconnected by a connecting portion, the heating element having an inverted U-shape when in a vertical position, to enable food to be placed between the legs.

10. A microwave oven as defined in claim 1, wherein the transmission member moves generally translationally when the gear is rotated.

11. A microwave oven comprising:

a body forming a cooking chamber;

a magnetron for generating microwaves to cook food within the chamber;

an electric heating element disposed in the cooking chamber for rotation about a generally horizontal axis, enabling the orientation of the heating element to be changed between a horizontal orientation and a vertical orientation, the heating element including a pair of legs interconnected by a connecting portion, the connecting portion being rotatably mounted to the body in an upper portion of the cooking chamber and defining the generally horizontal axis, the heating element forming an inverted U-shape when in the vertical orientation to enable food to be placed between the legs; and an electric motor operably connected to the connecting portion for rotating the heating element about the axis.

12. A microwave oven according to claim 11, further including a support for the heating element, the support being mounted in a vertical wall of the body for rotation about the axis, the heating element including first and second ends, both of the ends being mounted in the support alongside one another.

* * * * *